United States Patent [19]

Howell et al.

[11] 4,210,054

[45] Jul. 1, 1980

[54] HIGH NOTE PRIORITY MONOPHONIC BRASS KEYER SYSTEM

[75] Inventors: Stephen L. Howell, Jasper; Gary R. Fritz, Ferdinand, both of Ind.

[73] Assignee: Kimball International, Inc., Jasper, Ind.

[21] Appl. No.: 38,388

[22] Filed: May 14, 1979

[51] Int. Cl.[2] ..... G10H 1/02; G10H 5/12

[52] U.S. Cl. ..... 84/1.19; 84/1.25; 84/1.26; 84/DIG. 2; 84/DIG. 20

[58] Field of Search ..... 84/1.01, 1.11, 1.13, 84/1.19, 1.24–1.26, DIG. 2, DIG. 20

[56] References Cited

U.S. PATENT DOCUMENTS

| | | | |
|---|---|---|---|
| 3,389,211 | 6/1968 | Slaats | 84/1.01 |
| 3,715,445 | 2/1973 | Kniepkamp | 84/1.13 |
| 3,767,834 | 10/1973 | Hebeisen et al. | 84/1.19 |
| 3,882,751 | 5/1975 | Tomisawa et al. | 84/1.01 |
| 3,886,836 | 6/1975 | Hiyoshi | 84/1.26 |
| 3,924,505 | 12/1975 | Schrecongost | 84/1.01 |
| 4,028,978 | 6/1977 | Okamoto | 84/1.26 |
| 4,079,650 | 3/1978 | Deutsch et al. | 84/1.26 |
| 4,085,643 | 4/1978 | Griffith | 84/1.01 |
| 4,098,162 | 7/1978 | Okamoto et al. | 84/1.01 |
| 4,135,425 | 1/1979 | Doane et al. | 84/1.13 |

*Primary Examiner*—S. J. Witkowski

*Attorney, Agent, or Firm*—Albert L. Jeffers; John F. Hoffman

[57] ABSTRACT

A brass keyer system for an electronic organ wherein the keyboard is multiplexed to produce a polyphonic serial data stream, which is then converted to a monophonic serial data stream containing a keydown signal in a time slot corresponding to the highest note played on the keyboard. The monophonic data stream is converted to a multiple bit binary word that is used by the tone generation and keying portion of the system to produce a rectangular wave tone corresponding in frequency to the highest depressed key and having amplitude and pulse width modulation on attack and decay so as to produce a brass tone. The monophonic serial data stream is demultiplexed by means of a recirculating delay loop which repetitively recirculates the keydown pulse for the depressed key. The number of recirculations of this pulse are counted by a first counter and the position of the pulse within the delay loop is registered by a second counter, which is synchronized with the multiplexer. The outputs of the first counter form a first binary word representative of the octave of the highest depressed key, and the outputs of the second counter represent the pitch of the tone within that octave. Data selectors connected to the binary words select the appropriate pitch from the tone generator and the appropriate octave from the outputs of a divider so as to produce a single square wave tone of the proper frequency. Modified keydown pulses function as the amplitude and pulse width modulation envelopes, which impart to the square wave tone amplitude and pulse width modulation characteristic of brass tones. The octave select binary word is decoded and used to control the amount of differentiation of the square wave tone so that the pulse width modulation will track the position on the keyboard of the depressed key.

31 Claims, 7 Drawing Figures

HIGH NOTE PRIORITY MONOPHONIC BRASS KEYER SYSTEM

BACKGROUND OF THE INVENTION

The present invention is related to keyboard electronic musical instruments, such as electronic organs, and in particular to a system for producing a monophonic binary signal representative of a selected depressed key on the keyboard wherein this signal is utilized to control the tone generation and keying circuits of the organ, as, for example, in the production of brass tones.

Since the tonal quality of a note produced by a musical instrument is greatly dependent upon the harmonic content of the wave form, in electronic organs it is customary to generate rectangular waves which are then altered or filtered to produce wave forms having the desired harmonic content. The duty cycle of the rectangular waves has a very pronounced effect on harmonic content, with short duty cycles, that is, a narrow pulse width, sounding more brilliant, and a longer duty cycle sounding more mellow. An example of a more brilliant sound is that produced by a trumpet, whereas a saxaphone produces a more mellow tone.

A characteristic of the sound produced by brass instruments and some woodwind instruments is that during the attack portion of the tone, the amplitude increases and the tonal quality becomes more brilliant. In the case of square wave tones, this means that the duty cycle decreases with time during the attack. This sound may be simulated in a electronic organ by causing the tone to gradually increase in amplitude when the key is depressed with a gradual decrease in duty cycle. The duty cycle may either decrease simultaneously with the increase in amplitude, or lag the amplitude increase somewhat so as to simulate the effect which is produced when a mute is used with the trumpet or trombone. During decay, the pulse amplitude will decrease and the duty cycle will increase, so that the tone will decay and become more mellow.

Although a number of techniques for producing brass tones have been developed, they are often quite expensive to implement and are, thus, of limited use in a small organ format. Often, the prior art brass systems are responsive to polyphonic signals, wherein a plurality of the keys are simultaneously depressed. Since brass tones played as chords often sound muddy and unclear, brass is normally played monophonically, with one key being depressed at a time. Many prior art systems for converting the polyphonic output of a keyboard to a monophonic signal have been developed, and, although such systems would be useful for developing monophonic brass, this would restrict the flexibility of the overall organ. This is especially true in the case of synthesizers wherein it is often desirable to differently voice portions of chords played on the solo manual. If the keyboard output were only monophonic, then this technique would not be available.

Another problem is that of interfacing, in a cost effective manner, an inexpensive brass system in a multiplexed organ without substantially redesigning the existing organ circuitry. It is also desirable that any subsystem which is added to the organ be capable of adaptation to other uses simply and effectively.

SUMMARY OF THE INVENTION

The present invention overcomes the above discussed disadvantages of the prior art systems by providing a system for producing high quality brass sounds in a low cost organ format. Furthermore, the system can be interfaced with a polyphonic time division multiplexed serial data stream, which is converted to a monophonic multiple bit binary word, that is then used to key the appropriate tones and track the pulse width modulation for the brass keyer to the octave position of the priority depressed key of the keyboard.

The system is monophonic, in that it keys one tone at a time. The inputs to the brass keyer system are serial data from the multiplexed keyboard, the multiplexer latch command, high frequency clock, and twelve tone inputs from the tone generator. From these inputs, the brass system derives a single tone output, which varies in pulse width and amplitude during attack and decay so as to produce a brass effect.

Specifically, the system comprises a keyboard, a multiplexer for scanning the keyboard and developing a polyphonic serial data stream containing keydown signals pertaining to depressed keys of the keyboard, a tone generator capable of producing tones corresponding in pitch to the keys of the keyboard, and data processing means connected between the multiplexer and tone generator for receiving the polyphonic serial data stream and producing a monophonic data signal corresponding to a predetermined single depressed key of the keyboard, regardless of the number of keys which are depressed. The tone generator is responsive to the monophonic data signal for developing on an output terminal a tone corresponding to the predetermined single depressed key, and control means responsive to the actuation of the depressed key cause the amplitude and brilliance of the tone developed on the output terminal to increase with time so as to produce a brass tone.

In a subsystem of the present invention, demultiplexing of the monophonic serial data stream is accomplished by a recirculating delay loop, which is connected to receive the monophonic data stream and is synchronized therewith for circulating the keydown pulse corresponding to the predetermined depressed key. Counters connected to the delay loop provide a first count related to the number of times the keydown pulse is recirculated in the delay loop, and a second count related to the position of the keydown pulse within the delay loop. Latches connected to the counters latch the counts at a predetermined time in the scan of the keyboard so as to produce a binary word corresponding to the predetermined depressed key. The tone generation and keying circuits are connected to the latches to receive the binary word for producing a tone corresponding to the depressed key.

Polyphonic to monophonic conversion is accomplished by an electronic multistable device which is placed in a first state by the first occurring keydown pulse in the polyphonic data stream, and is placed in a second state by a signal generated by the multiplexer at or near the end of the scan of the keyboard, and by a gate connected between the multiplexer and demultiplexer and connected to the multistable device. The gate is enabled to pass the first mentioned serial data stream only in the second state so that only a single keydown pulse within the first-mentioned data stream will be passed to the demultiplexer.

In a further subsystem, the brass keyer tracks the position on the keyboard of the depressed key by decoding the monophonic binary signal and adjusting the pulse width modulation in response thereto. Such adjustment is independent of time and functions to achieve generally uniform duty cycle modulation throughout the range of frequencies playable on the keyboard.

DETAILED DESCRIPTION

Figure 1:
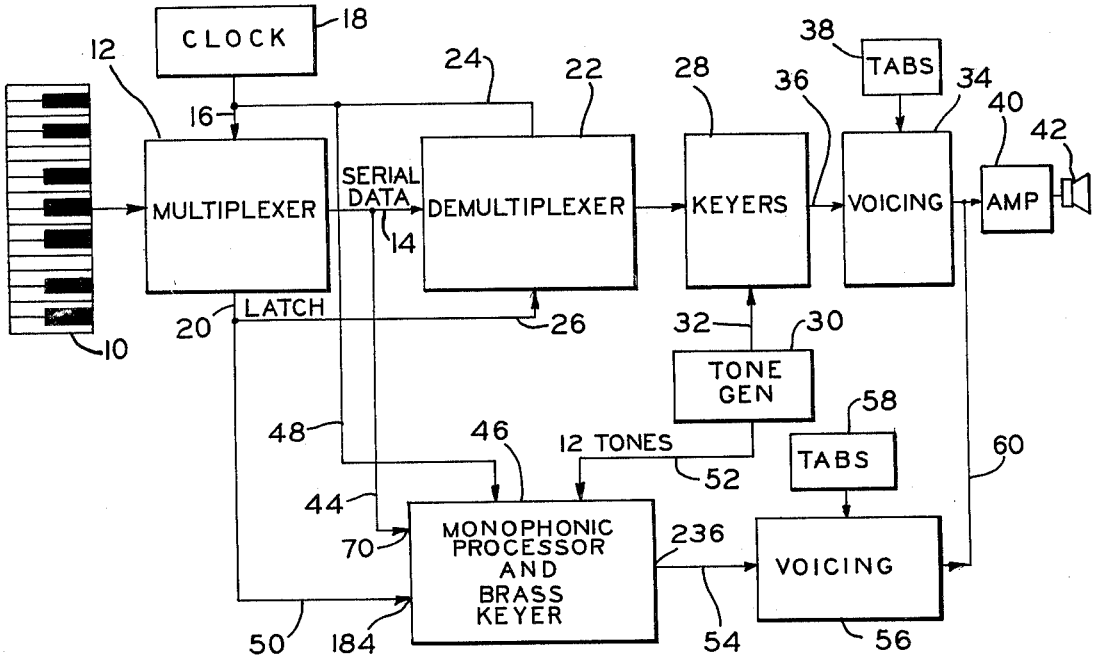
FIG. 1 is a simplified block diagram of an electronic organ incorporating the monophonic processor and brass keyer system according to the present invention.

Referring now to the drawings in detail, FIG. 1 illustrates, in greatly simplified form, an electronic organ comprising a keyboard 10 covering all of or at least a portion of the solo manual, a multiplexer 12 for cyclically scanning the keyboard 10 developing on output line 14 a time division multiplexed serial data stream comprising a plurality of time slots corresponding to respective keys of keyboard 10 wherein keydown signals, in the form of pulses, appear in time slots corresponding to depressed ones of the keys. For the purposes of this invention, the term "depressed" is to be construed in its broadest sense to mean any type of manual actuation. Multiplexer 12 is clocked by a clock train on line 16 from high frequency multiplex clock 18, and produces on line 20 the latch command, which is a pulse that is generated immediately following each scan of keyboard 10.

The serial data stream on line 14 is demultiplexed by demultiplexer 22, which is clocked by the clock train on line 24 from high frequency clock 18 so that it is synchronized with multiplexer 12. The latch command from multiplexer 12 is connected to demultiplexer 22 over line 26, which causes demultiplexer 22 to latch the multiplexed serial data stream and send it to keyers 28. Tone generator 30, which may be of any conventional design, is connected to keyers 28 over lines 32, and the tones from tone generator 30 are keyed by keyers 28 to the inputs of voicing circuit 34 over line 36. The voicing is controlled by manually actuated tabs 38 so as to impart the proper tonal characteristics to the signal supplied to the input of amplifier 40, the output of which is connected to speaker 42.

The serial data stream from multiplexer 12 is connected also to the serial data input line 44 of monophonic brass keyer 46, which is the subject of the present invention. The clock train from clock 18 is connected to brass keyer 46 over line 48, and the latch pulse from multiplexer 12 is connected to the appropriate input over line 50. Brass keyer 46 functions to convert the tones on lines 52 from tone generator 30 such that they have the quality of brass sounds by imparting to them both amplitude and pulse width modulation. The output 54 from brass keyer 46 is connected to voicing circuit 56, which is controlled by tabs 58 and connected to the input of amplifier 40 over line 60. Alternatively, the output 54 of brass keyer 46 could be connected directly to the input 36 of main voicing circuit 34.

Due to the fact that brass tones are normally played one key at a time, and since brass chords often have a muddy character to them, brass keyer 46 is monophonic with priority given to the highest key played on solo manual 10, or at least that portion of manual 10 capable of playing brass tones.

Figure 2A:
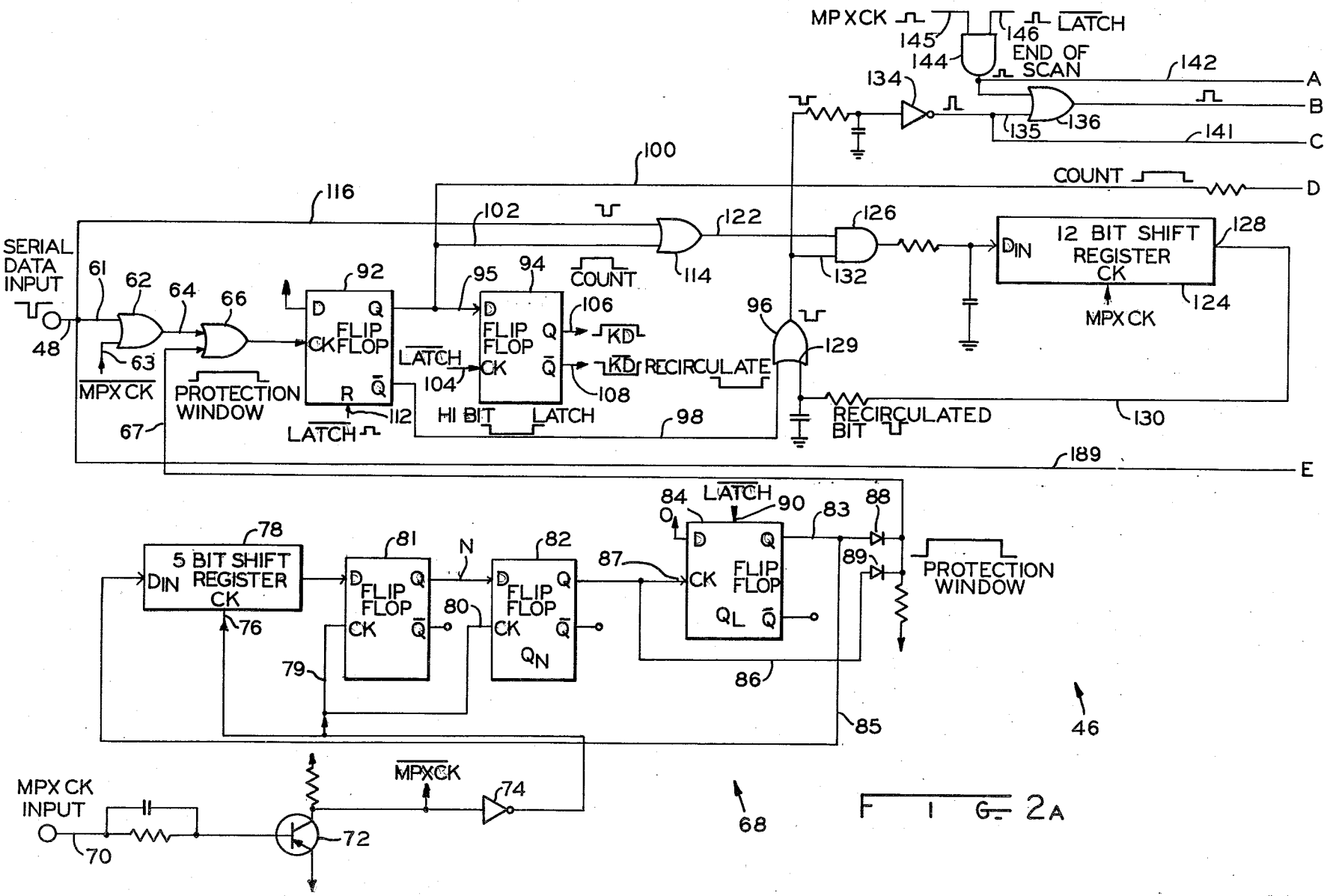
FIGS. 2A, 2B, 3A and 3B together constitute a detailed circuit schematic for the monophonic processor and brass keyer of FIG. 1.

Referring now to FIG. 2A, the serial data stream, wherein negative going pulses appear in time slots corresponding to depressed keys of keyboard 10, is connected to one of the inputs 61 of OR gate 62, the other input 63 being connected to the $\overline{\text{mpx}}$ clock pulse train, which is an inverted pulse train from clock 18. The purpose of gating the serial data stream in this manner is to chop the data stream so as to prevent two adjacent serial data pulses from appearing as one long data bit. The output of OR gate 62 is connected to one of the inputs 64 of OR gate 66, and the other input 67 thereof carries the protection window pulse produced by circuit 68.

The purpose of the protection window is to prevent the system from processing data bits which occur after the latch command from multiplexer 12, as, for example, fill note bits which are produced by auxiliary systems. One of the inputs for protection window circuit 68 is the multiplex clock input on line 70, which is inverted by transistor 72, and again by inverter 74, and is then connected to the clocking input 76 of five bit shift register 78, and to the clocking inputs 79 and 80 of D-type flip flops 81 and 82. The data in input for shift register 78 is connected to the Q output 83 of D-type flip flop 84 over line 85, and the output of shift register 78 is connected to the D input of D-type flip flop 81, and the output of shift register 81, line N, is connected to the D input of flip flop 82, with the output of second flip flop 82 connected to the clock input 87 of flip flop 84, and also to output line 67, the latter over line 86 and through diode 89. The Q output of flip flop 84 is also connected to line 67 through diode 88.

Figures 3B, 4:
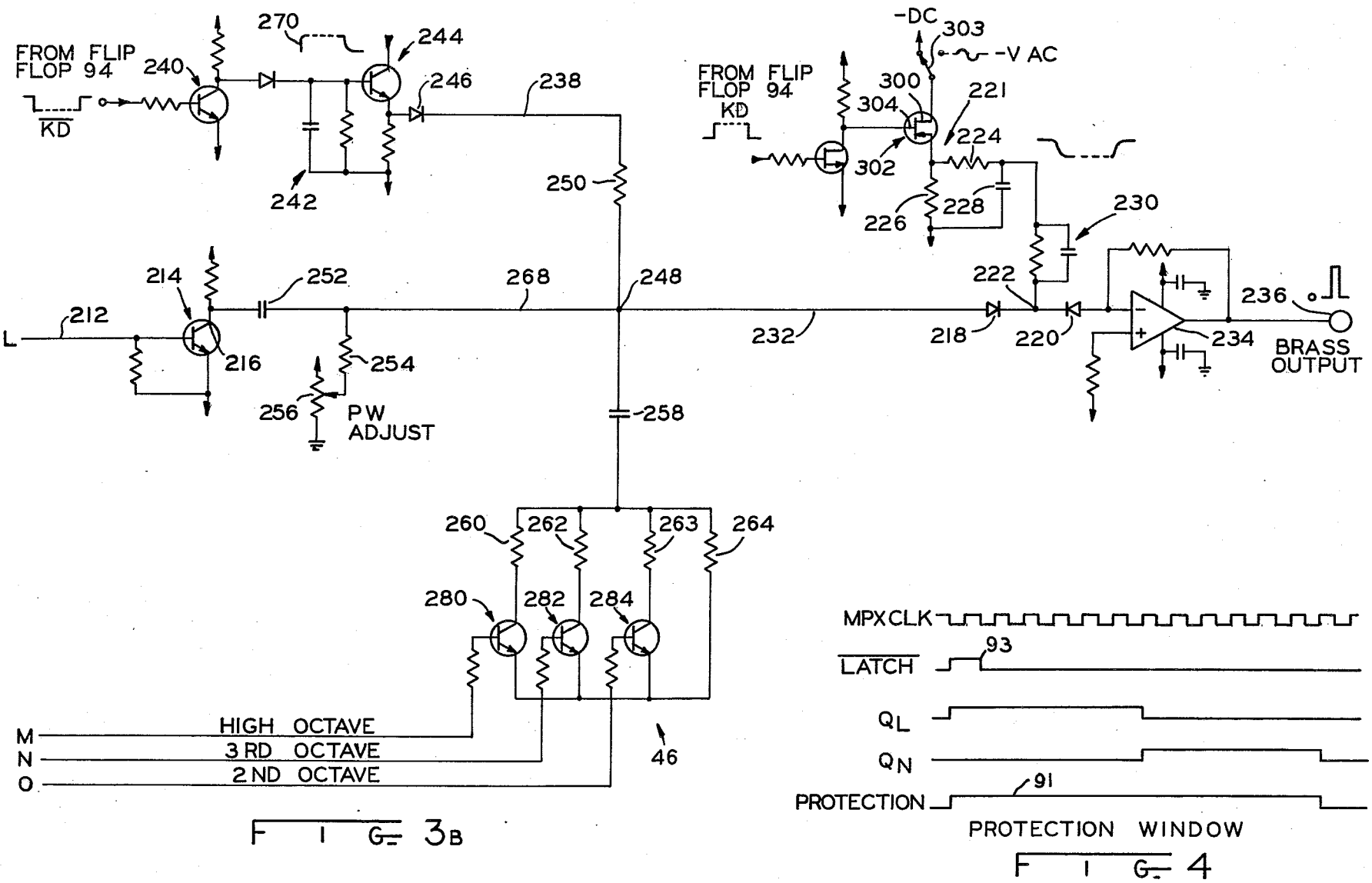
FIG. 4 is a timing diagram for the protection window pulse generator shown in FIG. 2A.

With reference to FIG. 4, it will be seen that protection window circuit 68 produces a positive going pulse 91 on line 85 for twelve and one-half multiplex clock cycles following the end of the scan of keyboard 10, which is sufficient to prevent any data pulses not directly produced by the keyboard from confusing the brass system. When the $\overline{\text{latch}}$ signal 93 on line 90 is received by flip flop 84, the Q output thereof goes high and remains high for six and one-half clock pulses due to the presence of shift register 78 and flip flops 81 and 82. After six and one-half pulses, the Q output of flip flop 84 will go low, but then the Q output of flip flop 82 will be high, and since it is also connected to line 85, the protection window will continue for another six pulses.

The output of OR gate 66 is connected to the clock input of flip flop 92, which has its Q output connected to the data input of flip flop 94 over line 95 and its $\overline{Q}$ output connected to one of the inputs of OR gate 96 over line 98. The purpose of flip flop 92 is to function as the serial data detector, which generates the signal which is used to activate the rest of the system. Flip flop 92 triggers on the positive, trailing edge of the data pulse and produces signals on lines 100 and 102 when the first data pulse in the serial data stream on input 48 is received. When flip flop 94 is clocked by the $\overline{\text{latch}}$ pulse on input 104, its Q output 106 produces a keydown pulse and its $\overline{Q}$ output 108 produces a $\overline{\text{keydown}}$ pulse, and these keydown pulses are utilized for pulse width and amplitude modulation of the tone signal, as will be described in detail later.

Figure 2B:
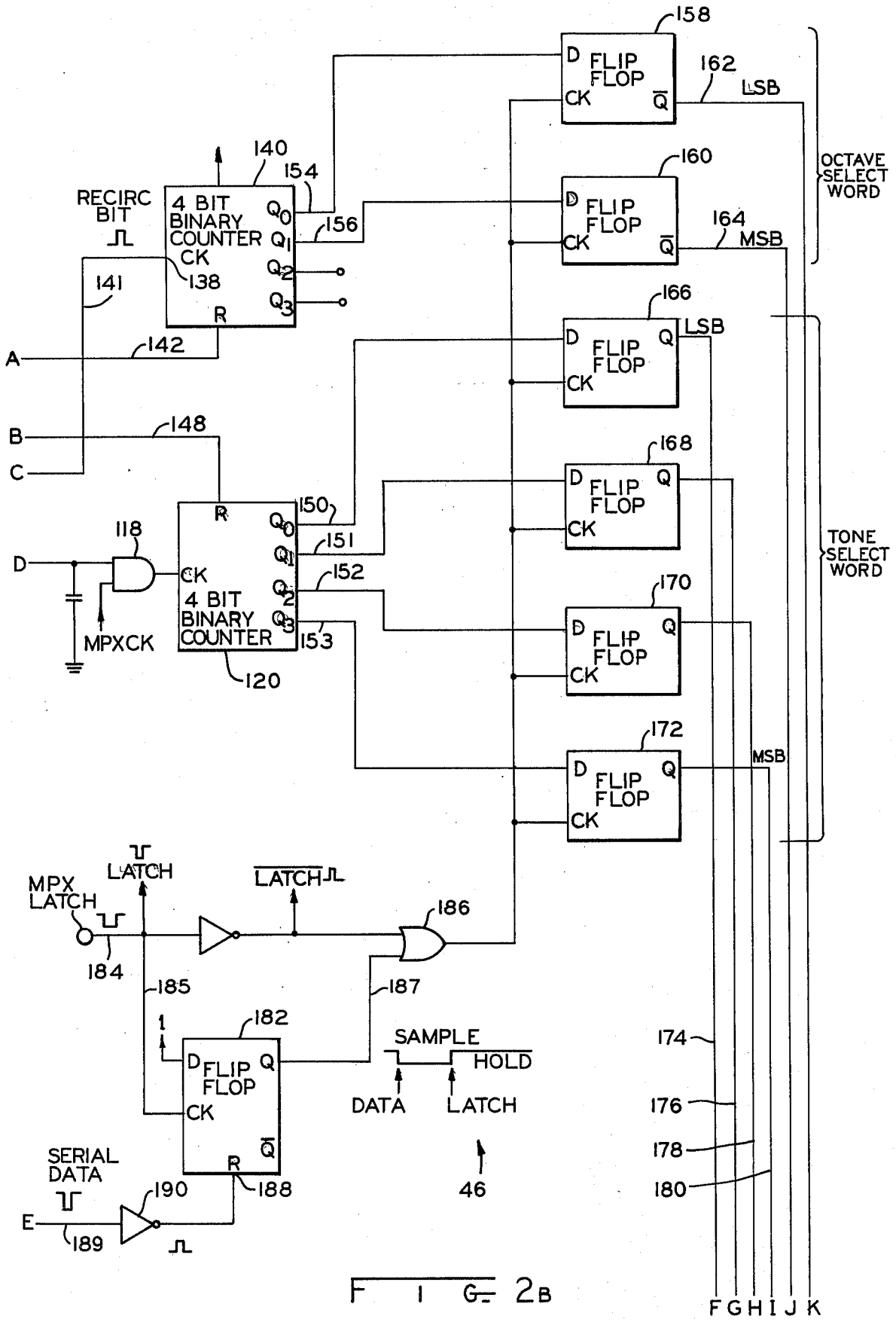

The Q output of flip flop 92 produces a count pulse which remains at logic level 1 from the trailing edge of the first chopped serial data bit on the serial data stream coming in on input 48 until the $\overline{\text{latch}}$ signal on the reset input 112 of flip flop 92 resets flip flop 92 thereby causing the Q output to go to logic 0. This count pulse output from flip flop 92 serves to disable OR gate 114 after the first data pulse on line 116 has passed therethrough until the end of the scan. This pulse further enables AND gate 118 (FIG. 2B) to clock four bit binary counter 120 during the same interval of time frames.

The purpose of the circuitry described above comprising OR gates 62, 66 and 114 and flip flop 92 is to ensure that only the first data pulse in the serial data stream appears at the output 122 of OR gate 114. This pulse is loaded into twelve bit shift register 124 through AND gate 126. Shift register 124 has its output 128 connected to one of the inputs 129 of OR gate 96 over recirculating line 130, and the output of OR gate 96 is connected to the other input 132 of AND gate 126, so that AND gate 126 functions to combine the initial bit from OR gate 114 with the recirculating bit which recycles every twelve multiplex clock pulses. OR gate 96 is enabled by the logic level 0 recirculate enable pulse on line 98 from the $\overline{Q}$ output of flip flop 92. This pulse lasts from the trailing edge of the first data pulse until the $\overline{\text{latch}}$ command is received by flip flop 92. At the end of the scan of keyboard 10, the recirculate command on line 98 from flip flop 92 will go high causing OR gate 96 to be disabled and recirculation will cease.

The recirculating pulse from the output of OR gate 96 is inverted by inverter 134 and fed to one of the inputs 135 of OR gate 136, and is also connected to the clock input 138 of four bit binary counter 140 over line 141. Counter 140 (FIG. 2B) counts the number of times the data pulse recirculates through shift register 124 and is, therefore, representative of the number of octaves between the depressed key and the end of the keyboard 10, which is scanned downward from the highest key to the lowest. Counter 140 is reset by the end of scan pulse on line 142, which is generated by AND gate 144. The inputs to AND gate 144 are the multiplex clock input on 145 and the $\overline{\text{latch}}$ input on line 146. The inverted recirculating pulse is gated by OR gate 136 to reset counter 120 over line 148. Thus, counter 120 is reset every octave, and the count at its outputs 150, 151, 152 and 153 remaining just before the end of the scan of keyboard 10 can be used to represent the pitch of the depressed key of keyboard 10.

Connected to the $Q_0$ and $Q_1$ and outputs 154 and 156, respectively, of octave counter 140 are D-type flip flops 158 and 160, which function as latches to latch the least significant bit of counter 140 on $\overline{Q}$ output 162 of flip flop 158 and the most significant bit of counter 140 on $\overline{Q}$ output 164 of flip flop 160, which together form a two bit octave select word. It will be recalled that octave counter 140 is clocked each time the recirculating bit from shift register 124 appears, and is, therefore, a count of the number of complete octaves from the appearance of the first data bit to the end of the scan.

In a similar fashion, four D-type flip flops 166, 168, 170 and 172 are connected to the $Q_0$ output 150, $Q_1$ output 151, $Q_2$ output 152 and $Q_3$ output 153 of pitch binary counter 120. Flip flops 166, 168, 170 and 172 function to latch the four bit binary tone select word representative of the number of time slots between the last occurring recirculate bit on line 148 and the end of the scan. The binary tone select word appears on lines 174, 176, 178 and 180.

Flip flop 182 serves to hold the octave select and tone select words at the outputs of flip flops 158, 160, 166, 168, 170 and 172 so that there will not be an abrupt termination of the sound when the depressed key is released, which would otherwise occur when serial data no longer is present. The multiplex latch input 184 is applied to the clock input of D-type flip flop 182 over line 185, and its Q output is connected to one of the inputs of OR gate 186 over line 187. The output of OR gate 186 is connected to the clock inputs of flip flop 158, 160, 166, 168, 170 and 172, and clocks these flip flops whenever the multiplex latch command is received on input 184 which causes the Q output of flip flop 182 to go to logic 1. The reset input 188 of flip flop 182 is connected to the serial data input 48 over line 189 through inverter 190.

In operation, at the beginning of a scan, the Q output of flip flop 182 will be at logic 1, but when the first data pulse appears, flip flop 182 will be reset so that its Q output will go to logic level 0. It will remain at logic 0 until the latch pulse is received at input 184 thereby clocking flip flop 182 and causing its Q output to go to logic 1. The latch input also serves to clock flip flops 158, 160, 166, 168, 170 and 172 to latch the octave and tone counts at their input to their output lines 162, 164, 174, 176, 178 and 180. Because the Q output of flip flop 182 will go to logic 1 at this time and remain at logic 1 until the data pulse is received on the next scan, the outputs of flip flops 158, 160, 166, 168, 170 and 172 will remain at the count present at their inputs when the multiplexed latch pulse is received. This will allow the sustain-type keyers in the brass keyer system to decay exponentially without loss of octave or tone counts if serial data doesn't occur on the next scan or scans.

Figure 3A:
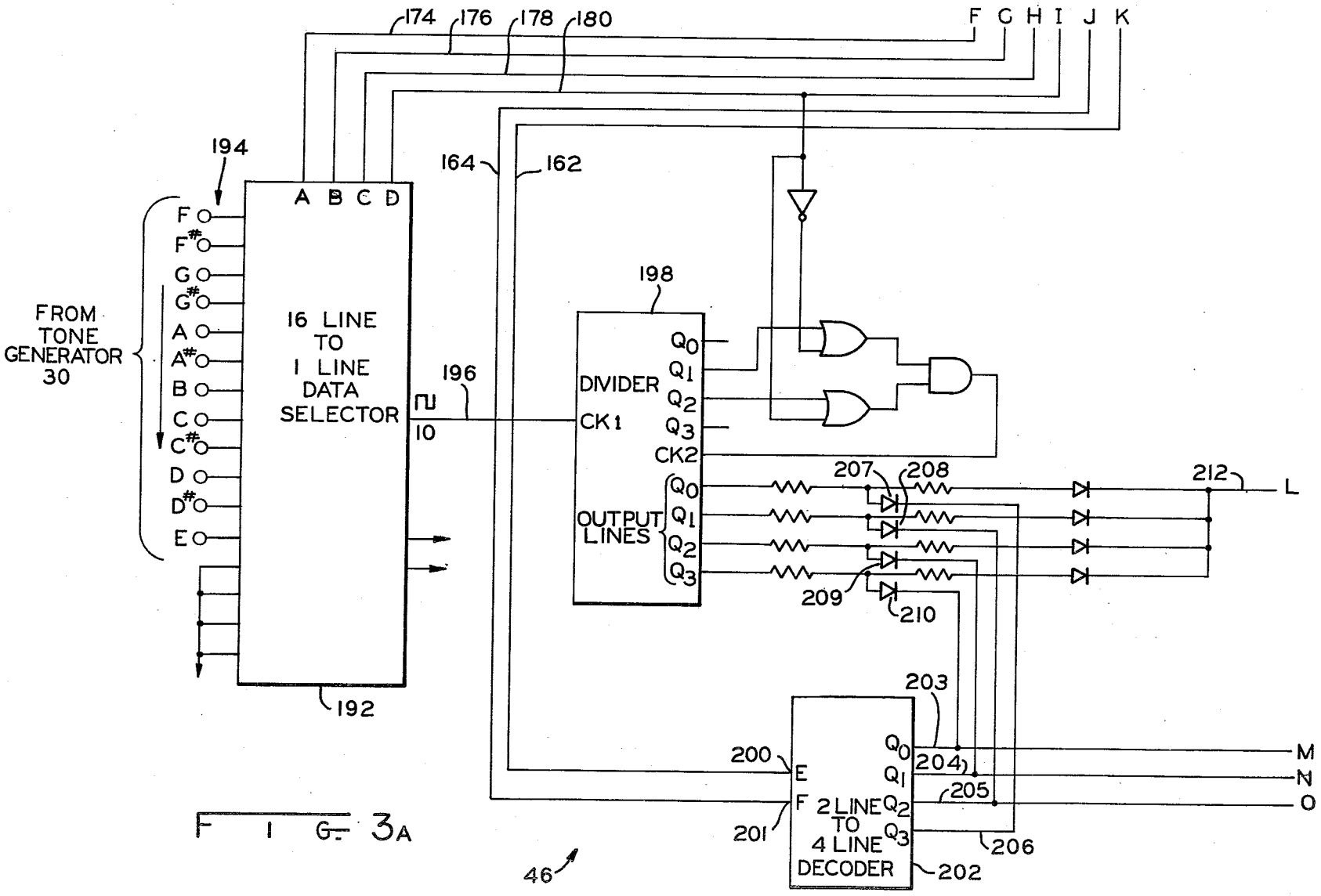

With reference now to FIG. 3A, the manner in which the pitch and octave information is utilized to select the proper tone will be described. The four bit binary tone select word on lines 174, 176, 178 and 180 is connected to one set of inputs of sixteen line to one line data selector 192, and twelve of its sixteen data input lines 194 are connected to the twelve tone outputs of tone generator 30. These tones represent one octave of equal tempered frequencies. Depending on the four bit word on lines 174, 176, 178 and 180, one of the input tones on lines 194 will be selected so that its tone, which is a square wave, will appear on output line 196. This tone is connected to the clock input of divider 198, which produces on output lines $Q_0$, $Q_1$, $Q_2$, and $Q_3$ the input tone in the first (top) octave, the second octave, third octave and the fourth (low) octave, respectively. Sixteen line to one line data selector 192 is a 74C150 type, and divider 198 is a 14520 type.

The two bit octave select word on lines 162 and 164 is connected to the select inputs 200 and 201 of 14555 decoder 202, which activates one of its output lines 203, 204, 205 or 206 so as to select one of the $Q_0$, $Q_1$, $Q_2$, and $Q_3$ outputs of divider 198 by turning off the respective diode 207, 208, 209 and 210, respectively. Thus, there appears on line 212, which is connected to the base of transistor 214 (FIG. 3B), a tone of the pitch and octave corresponding to the highest depressed key of keyboard 10.

On the collector 216 of transistor 214 is the tone which is to be amplitude and pulse width modulated. The keying as accomplished by means of a discrete keyer of the type disclosed in U.S. Pat. No. 3,389,211 and comprises oppositely poled diodes 218 and 220 having the amplitude control signal from circuit 221 connected to their juncture 222. The keydown pulse from output 106 of flip flop 94 causes an attack and decay to be generated exponentially by the RC circuit comprising resistors 224 and 226 and capacitor 228. This signal passes through RC circuit 230 to the juncture 222 of diodes 218 and 220. As is well known, as the voltage at juncture 222 decreases, diodes 218 and 220 will become more conductive so that the tone signal on line 232 will be passed with greater amplitude to the inverting input of operational amplifier 234, the output 236 of which carries the brass tone. In organ tones having good brass characteristics, the amplitude increases exponentially when the key is depressed, and decreases exponentially when the key is released. This is what is accomplished by the amplitude modulation circuit just described.

Another characteristic of brass tones is that their brilliance increases beginning with or shortly following the depression of the key until steady state condition is reached, and this may be accomplished by utilizing square wave tones wherein the duty cycle decreases during attack and increases during decay. This is accomplished in the present circuit by exponentially varying the duty cycle of the tone at the collector 216 of transistor 214, and is achieved by generating a DC control signal on line 238 which is controlled by the $\overline{\text{keydown}}$ output of flip flop 94 but attacks and decays exponentially. The $\overline{\text{keydown}}$ output from flip flop 94 is connected to the base of transistor 240, and the RC circuit 242 at the input of transistor 244 produces such a signal at the cathode of diode 246, which is connected to juncture point 248 through resistor 250.

The tone signal on collector 216 is differentiated by the RC circuit comprising 0.056 microfarad capacitor 252, 47K resistor 254, 10K potentiometer 256, 0.33 microfarad capacitor 258, which is selected such that its reactance is low compared to the resistances in the circuit, 4.7K resistor 260, 10K resistor 262, 15K resistor 263 and 15K resistor 264. As will be described in greater detail below, only one of resistors 260, 262, and 263 will be enabled.

Figure 5:
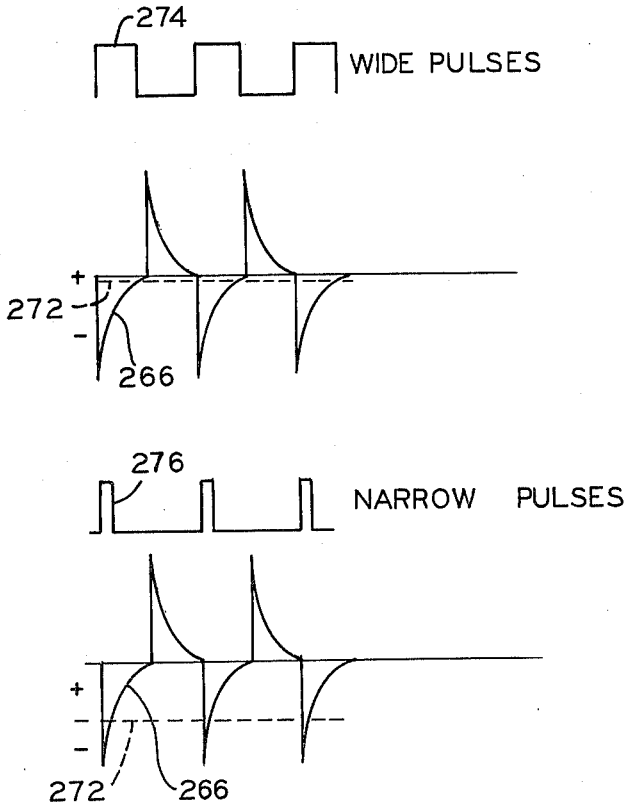
FIG. 5 is a diagram showing the relationship between the differentiated square wave pulses and the output tone corresponding to two different points in the pulse width modulation attack envelope.

The differentiation of the tone pulses at the collector 216 of transistor 214 is illustrated diagrammatically in FIG. 5 by waveform 266. Since the diode keyer comprising diodes 218 and 220 is only affected by the negative portion of the pulse train on line 232, current to the inverting input of operational amplifier 234 will be present only when the voltage at juncture 248 is negative. The purpose of the DC modified keydown signal on line 238 is to provide an offset at juncture 248 so as to change the respective positive and negative portions of the pulse train on line 268 in a time varying fashion with the attack and release of the depressed key. In other words, the DC voltage at juncture 248 causes the pulse train on line 268 to move increasingly more positive after the initial key actuation due to the exponential shape of the initial portion 270 of the modified keydown signal at transistor 244.

This relationship is illustrated in FIG. 5 wherein line 272 represents the 0 voltage point, and at the initiation of the keydown signal, it will be seen that the major portion of differentiated pulses 266 is negative thereby producing pulses at the output of operational amplifier 234 which are relatively wide. For example, pulses 274 may have a duty cycle of fifty percent. As the DC offset voltage at juncture 248 increases exponentially with time, it will be seen that the pulse train on line 268 will be shifted positively as shown in the lower portion of FIG. 5 wherein the major portion of pulses 266 are located above the zero voltage line 272. Since the tone pulses are keyed by diodes 218 and 220 into the input of operational amplifier 234 only for the negative voltage portions of the pulse train on line 232, this will produce a pulse train 276 having a narrow pulse width, with a typical duty cycle of only six percent by the time steady state conditions relative to the DC voltage on line 238 are reached.

As is well known, rectangular wave tones of low duty cycle have a tonal quality which is more brilliant than rectangular wave tones having a larger duty cycle. Thus, the tone appearing at the output 236 of operational amplifier 234 will being with a small amplitude and large duty cycle, which results in a more mellow, lower volume tone, and progress exponentially to a higher, steady state amplitude and smaller duty cycle, thereby sounding louder and more brilliant. These are the characteristics of good brass tones in electronic organs.

In brass keying, it is desirable to maintain the duty cycles of tones generally uniform throughout the entire length of the keyboard. The duty cycle pulse width relationship is variable with frequency, however, so that there would be different characteristics for tones of equal pulse width depending on whether they were played on the high end or low end of the keyboard. In order to permit the system to track the frequency of the tone played, resistors 260, 262 and 263 are selectively switched in parallel with resistor 264 by transistors 280, 282 and 284 thereby selectively changing the character of the RC differentiation circuit comprising resistors 256, 254 and 250, capacitors 252 and 258, and selected ones of resistors 260, 262, 263 and 264. Transistors 280, 282 and 284 have their bases connected to the $Q_0$, $Q_1$, and $Q_2$, respectively, outputs of two to four line decoder 202, so that if the octave word on inputs 200 and 201 of decoder 202 corresponds to the highest octave of manual 10, transistor 280 will be turned on thereby placing the 4.7K resistor 260 in the differentiation circuit in parallel with resistor 264. If the octave word corresponds to the third octave, transistor 282 will be turned on, and so on.

Since it is desirable to maintain the duty cycle fairly constant over the entire keyboard 10, for higher frequencies it will be necessary to differentiate the pulses to a greater degree so that they are "sharper." This will cause the proper percentage of the pulse, relative to the entire pulse period, to lie in the negative, operable portion of the voltage excursion. This is accomplished by decreasing the resistance connected to capacitor 258 for higher frequency tones, and increasing this resistance for lower frequency tones.

In order to provide some degree of player control, the pulse width may be manually adjusted by potentiometer 256. Resistor 250 may be factory set to establish the desired amount of pulse width modulation.

If tremulant is desired, an AC signal of from 0.05 to 6 Hz. may be applied to the collector 300 of transistor 302 by throwing switch 303. This causes the voltage on base 304 essentially to follow the variations of the collector 300 so that the emitter voltage, which is the keying voltage, will be a DC value plus or minus the AC variation. Thus, the amplitude modulation will vary cyclically, preferably after steady state conditions are reached. This will also cause the offset voltage at point 248 to vary slightly in cyclic fashion so as to modulate the pulse width of the resultant signal at terminal 236.

It should be noted that the particular technique for tracking the keyboard described above in connection with controlling the pulse width modulation has other modifications. For example, attack and decay could also be tracked on an octave or individual key basis as, for example, in simulating a pipe organ wherein the pipes attack differently in the high frequencies than in the low frequencies. Furthermore, in producing a high quality violin tone, the saw-tooth waves could be modified depending on the frequency played. Normally, it is desirable to maintain the saw-tooth wave with a constant slope throughout the frequency range of the keyboard 10. Because the keyboard information is brought in in pitch and octive binary word format, the system is very easily adaptable to track a variety of tone characteristics to the keyboard.

Because the system is monophonic, it would interface quite well with existing synthesizer technology. Again, the pitch and octave format for the keyboard information renders this a very flexible and adaptable system for use with many types of organ keying and voicing technology.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. An electronic musical instrument comprising:

a keyboard, multiplex means for scanning said keyboard and developing a polyphonic serial data stream containing keydown signals pertaining to depressed keys of the keyboard, tone generator means capable of producing tones corresponding in pitch to the keys of the keyboard, data processing means connected between said multiplex means and said tone generator means for receiving said polyphonic serial data stream and producing a monophonic data signal corresponding to a predetermined single one of the depressed keys of the keyboard regardless of the number of keys which are depressed, said tone generator means being responsive to said monophonic data signal for developing on an output terminal a tone corresponding to said predetermined single key, and control means connected to said tone generator means and responsive to the actuation of the predetermined single key for causing the amplitude and brilliance of the tone developed on the output terminal to increase with time so as to produce a brass tone.

2. The electronic musical instrument of claim 1 wherein said tone developed by said tone generator means is a rectangular wave signal, and said control means causes the duty cycle of said rectangular wave signal to decrease with time so as to produce an increasingly more narrow effective pulse width following actuation of said predetermined single key, and said control means causes the duty cycle of said rectangular wave signal to increase with time so as to produce an increasingly more wide effective pulse width following deactivation of said predetermined single key.

3. The electronic musical instrument of claim 1 wherein said polyphonic serial data stream is time division multiplexed, and said data processing means demultiplexes the polyphonic serial data stream and the monophonic data signal produced thereby is a multiple bit binary word in pitch and octave format, wherein certain of the bits contain octave information and the other bits contain pitch information corresponding to the predetermined single key.

4. The electronic musical instrument of claim 3 wherein said data processing means comprises: a recirculating delay means synchronized with the multiplex means which recirculates a selected single bit of the serial data stream, and counter means connected to said delay means for counting the number of times the single bit is recirculated in the delay means and for registering the position of the single bit in the delay means, said counter means producing said pitch and octave format binary word.

5. The electronic musical instrument of claim 1 wherein said tone developed by said tone generator means is a rectangular wave signal, said control means causes the duty cycle of said rectangular wave signal to decrease with time so as to produce an increasingly more narrow effective pulse width following attack of the key, said control means is responsive to the monophonic data signal and tracks the position of the predetermined single key on the keyboard so as to modify the duty cycle of the rectangular wave signal in accordance with the frequency of the tone corresponding to the predetermined single key.

6. A keyboard electronic musical instrument comprising:

a keyboard, multiplex means for scanning the keyboard and developing a cyclically recurring polyphonic time division multiplexed serial data stream containing keydown pulses in time slots pertaining to depressed ones of the keys of the keyboard, polyphonic to monophonic conversion means connected to said multiplex means for converting said polyphonic serial data stream to a monophonic serial data stream synchronized with said multiplex means and said polyphonic data stream and containing a selected keydown pulse in only one time slot corresponding to a predetermined one of the depressed keys, recirculating delay means connected to said conversion means and synchronized with said monophonic data stream for recirculating said selected keydown pule in a closed delay loop, counting means connected to said delay means, at least in part synchronized with said multiplexed means, for producing a first count related to the number of times the selected keydown pulse is recirculated in the delay loop and a second count related to the position of the selected keydown pulse within the delay loop, latch means connected to said counting means for latching said counts at a predetermined time in the scan of the keyboard so as to produce a binary word corresponding to the keys pertaining to said selected keydown pulse, and tone generation and keying means connected to said latch means to receive said binary word for producing a tone corresponding to the key pertaining to said selected keydown pulse.

7. The electronic musical instrument of claim 6 wherein said polyphonic to monophonic conversion means is activated by the first keydown pulse in the polyphonic serial data stream, and the monophonic serial data stream produced thereby contains a single keydown pulse which is in the time slot corresponding to the time slot of said first keydown pulse.

8. The electronic musical instrument of claim 7 wherein said polyphonic to monophonic conversion means comprises: an electronic bistable device which is placed in a first state by said first keydown pulse in the polyphonic data stream and is placed in the second state by a second signal generated by said multiplex means at the end of the scan of the keyboard, and a gate connected between said multiplex means and said delay means and connected to said bistable device, said gate being enabled to pass said first mentioned serial data stream only when in said second state.

9. The electronic musical instrument of claim 6 wherein said delay loop comprises a shift register having its output connected to its input through gating means.

10. The electronic musical instrument of claim 6 wherein said counting means comprises: a first counter means having its input operatively connected to a point on said delay loop, said counter means produces a count on its output representative of the number of times the selected keydown pulse recirculates within the delay loop, and a second counter means clocked in synchronism with said multiplex means and having its reset input connected to said delay loop, said second counter means being reset each time the selected keydown pulse makes one complete circulation through said delay loop.

11. The electronic musical instrument of claim 6 wherein said keyboard comprises respective keys corresponding to a plurality of keys in a plurality of octaves, said first count is representative of the octave of said one depressed key, and said second count is representative of the pitch of said one depressed key in any of the octaves.

12. The electronic musical instrument of claim 6 wherein said tone generation and keying means comprises a tone generator capable of producing tones corresponding to the keys of the keyboard, and further including means responsive to said binary word for selecting one of said tones, said one tone corresponding to the key of the keyboard pertaining to said selected keydown pulse.

13. The electronic musical instrument of claim 12 wherein said tone generator produces at least the twelve tones of an octave, and said means for selecting comprises: decoder means connected to receive said twelve tones and at least a portion of said binary word and selects one of said twelve tones in response to said portion of the binary word, and selectable divider means connected to receive the selected one of the twelve tones and other portion of said binary word, said divider means selectively divides said one of the twelve tones by octaves in response to said other portion of the binary word.

14. The electronic musical instrument of claim 6 wherein: said tone generation and keying means produces a rectangular wave signal and modulates the duty cycle and amplitude of said rectangular wave signal over time following key actuation such that the amplitude increases and duty cycle decreases until a steady state level is reached, thereby producing a brass tone.

15. The electronic musical instrument of claim 14 wherein the rectangular wave signal has a pulse width and said tone generation and keying means modifies the pulse width independently of time depending on the position of the predetermined depressed key corresponding to said binary word.

16. The electronic musical instrument of claim 15 wherein the pulse width modified independently of time is narrower when the predetermined depressed key is of a higher frequency and wider when the predetermined depressed key is of a lower frequency.

17. A keyboard electronic musical instrument multiplex means for scanning the keyboard and developing a cyclically recurring polyphonic time division multiplexed serial data stream containing keydown signals in time slots pertaining to depressed ones of the keys of the keyboard, demultiplex means, polyphonic to monophonic conversion means connected between said multiplex means and said demultiplex means for converting said polyphonic serial data stream to a monophonic serial data stream synchronized with said multiplex means and containing a selected keydown pulse in only one time slot corresponding to a predetermined one of the depressed keys, said polyphonic to monophonic conversion means comprising an electronic multistable device which is placed in a first state by the first occurring keydown pulse in the polyphonic data stream and is placed in the second state by a signal generated in synchronism with said multiplex means at or near the end of the scan of the keyboard, and gate means connected between said multiplex means and said demultiplex means and connected to said multistable device, said gate means being enabled to pass said first mentioned data stream only when in said second state, said demultiplex means demultiplexing said monophonic data stream produced by said polyphonic to monophonic conversion means to produce a binary signal corresponding to the key pertaining to the first keydown pulse in the polyphonic data stream.

18. The electronic musical instrument of claim 17 wherein said polyphonic data stream runs parallel with said monophonic data stream and is in synchronism therewith.

19. An electrical musical instrument comprising:

a keyboard having playing keys respectively associated with tones of a multiple octave scale, said keys being arranged in succession, processor means connected to said keyboard for producing a binary signal corresponding to a depressed key of the keyboard, tone generator means for generating rectangular wave tones, and brass keyer means connected to said processor means and to said tone generator means for developing a square wave signal comprising time sequential pulses at the frequency corresponding to the depressed key wherein the amplitude of the square wave signal increases and the duty cycle of the square wave decreases with time to a steady state value after key attack, said brass keyer means including tracking means for adjusting the pulse width of the square wave signal pulses independently of time but dependent on the position of the depressed key on the keyboard so that the pulse width of the square wave signal tracks the position on the keyboard of the depressed key.

20. The electronic musical instrument of claim 19 wherein said processor means comprises a multiplex means for scanning the keyboard and developing a polyphonic time division multiplexed serial data stream, and a polyphonic to monophonic converter for converting said polyphonic data stream to a monophonic data signal corresponding to a single depressed key of the keyboard regardless of the number of keys actually depressed.

21. The electronic musical instrument of claim 20 wherein said tone generator means is capable of producing tones corresponding to respective keys of the keyboard, and said keyer means comprises data selector means responsive to said binary word for selecting the tone corresponding to the key pertaining to said binary signal.

22. The electronic musical instrument of claim 19 wherein:

said binary signal is a multiple bit binary word wherein some of said bits represent the octave of the note pertaining to the depressed key and the other bits represent the pitch of the note in said octave, said tone generator means is capable of producing tones corresponding to respective keys of the keyboard, said keyer means comprises data selector means responsive to said binary word for selecting a tone corresponding to the key pertaining to said binary signal, said tracking means is responsive to the bits of said binary word representative of the octave of the note pertaining to the depressed key to adjust the pulse width of the rectangular wave pulses.

23. The electronic musical instrument of claim 22 including means responsive to the depression of said key of the keyboard for developing a keydown pulse having a duration coextensive with the depression of said key, wherein said keyer means adjusts the wave shape of said keydown pulse to control the duty cycle decrease with time of the rectangular wave signal, and said tracking means adjusts the wave shaping of said keydown pulse independently of time in response to the bits of said binary word representative of the octave of the note pertaining to the depressed key.

24. The electronic musicial instrument of claim 23 wherein said keyer means includes an RC circuit means for properly shaping said keydown pulse, and said tracking means selectively alters the impedance of said RC circuit means.

25. The electronic musical instrument of claim 19 including means responsive to the depression of said key of the keyboard for developing a keydown pulse having a duration coextensive with the depression of said key, and wherein said brass keyer means comprises:

first RC circuit means for imparting an exponential attack and decay to said keydown pulse so as to produce an amplitude keying envelope, second RC circuit means for imparting an exponential attack and decay to one of said keydown pulse or an inversion thereof to produce a pulse width modulation envelope, means for differentiating a rectangular wave tone from said tone generator means, diode keyer means connected to receive said amplitude keying envelope and the differentiated rectangular wave signal for developing at an output terminal a rectangular wave tone having an amplitude controlled by the amplitude keying envelope and a duty cycle controlled by the differentiated rectangular wave signal and the pulse width modulation envelope.

26. The electronic musical instrument of claim 25 wherein the pulse width modulation envelope controls a voltage offset for the differentiated rectangular wave signal supplied to said diode keyer.

27. The electronic musical instrument of claim 25 wherein said tracking means receives said binary signal and adjusts the impedance of the second RC circuit means in response to said binary signal.

28. The electronic musical instrument of claim 27 wherein said binary signal is a multiple bit binary word wherein some of said bits represent the octave of the note pertaining to the depressed key, and said tracking means is responsive to that portion only of said binary word consisting of said some of said bits.

29. An electronic musical instrument comprising:

a keyboard having playing keys respectively associated with tones of a multiple octave scale and arranged in succession, multiplex means for scanning the keyboard and developing a cyclically recurring polyphonic time division multiplexed serial data stream containing keydown pulses in time slots pertaining to depressed ones of the keys of the keyboard, polyphonic to monophonic conversion means connected to said multiplex means for converting said polyphonic data stream to a monophonic data stream synchronized with said multiplex means and containing a keydown pulse in only one time slot corresponding to a predetermined one of the depressed keys, means connected to receive said monophonic serial data stream for producing a multiple bit binary word corresponding to said monophonic data stream, tone generating and keying means connected to receive said binary word for producing at an output terminal a tone having a frequency corresponding to said one of said depressed keys and having given tonal characteristics and attack and decay characteristics, said tone generating and keying means including tracking means connected to receive said binary word for adjusting at least one of said characteristics in response to said binary word so that said one characteristic tracks the position of said one depressed key on the keyboard.

30. The electronic musical instrument of claim 29 wherein some of the bits of said binary word represent the octave of said one depressed key, and said tracking means is responsive to that portion only of said binary word consisting of said some of said bits.

31. The electronic musical instrument of claim 1 including tremulant means for cyclically varying the amplitude and brilliance of the tone after the tone reaches steady state conditions.

* * * * *

UNITED STATES PATENT AND TRADEMARK OFFICE

CERTIFICATE OF CORRECTION

PATENT NO. : 4,210,054

DATED : July 1, 1980

INVENTOR(S) : STEPHEN L. HOWELL and HARY R. FRITZ

It is certified that error appears in the above-identified patent and that said Letters Patent are hereby corrected as shown below:

Column 8, line 16, change "being" to --begin--.

Claim 6, Column 10, line 54, change "pule" to --pulse--.

Claim 19, Column 12, line 50, change "electrical" to -- electronic --.

Signed and Sealed this

*Twenty-eighth* Day of *October 1980*

[SEAL]

*Attest:*

SIDNEY A. DIAMOND

*Attesting Officer*

*Commissioner of Patents and Trademarks*